US007337645B2

(12) United States Patent
Davis et al.

(10) Patent No.: US 7,337,645 B2
(45) Date of Patent: Mar. 4, 2008

(54) DRAW PRESS WITH A FIXED DRAW PUNCH AND A FLOATING DRAW PUNCH

(75) Inventors: John W. Davis, Ypsilanti, MI (US); Kevin J. Blaser, Brighton, MI (US); Gary L. Smith, Shelbyville, KY (US)

(73) Assignee: Ford Motor Company, Dearborn, MI (US)

( * ) Notice: Subject to any disclaimer, the term of this patent is extended or adjusted under 35 U.S.C. 154(b) by 0 days.

(21) Appl. No.: 11/460,361

(22) Filed: Jul. 27, 2006

(65) Prior Publication Data

US 2008/0022747 A1 Jan. 31, 2008

(51) Int. Cl.
*B21D 22/00* (2006.01)

(52) U.S. Cl. ..... 72/348; 72/351; 72/453.13

(58) Field of Classification Search ..... 72/347, 72/348, 349, 350, 351, 404, 385, 381, 472, 72/312, 313

See application file for complete search history.

(56) References Cited

U.S. PATENT DOCUMENTS 1,818,332 A * 8/1931 Johnson ..... 72/328
2,869,177 A 1/1959 Jurgeleit
4,571,979 A 2/1986 Baba et al.
4,615,204 A 10/1986 Yamamoto et al.
4,909,061 A 3/1990 Reitter et al.
5,365,767 A 11/1994 Kitchen et al.
6,530,255 B1 3/2003 Usui et al.
6,622,539 B2 9/2003 Hartzinger et al.
6,626,023 B1 * 9/2003 Kodani ..... 72/453.13

FOREIGN PATENT DOCUMENTS

JP 59047028 3/1984
JP 07227623 8/1995

* cited by examiner

*Primary Examiner*—Derris H. Banks
*Assistant Examiner*—Debra M Wolfe
(74) *Attorney, Agent, or Firm*—Raymond L. Coppiellie; Brooks Kushman P.C.

(57) ABSTRACT

A machine is disclosed for producing a deep drawn part and a shallow drawn part from sheet metal blanks in a single action draw press. A floating draw punch and a fixed draw punch are provided. The first draw die forms a part that is drawn over the fixed draw punch while the second blank does not begin forming the second part until the floating draw punch bottoms out on the bed of the press. The floating draw punch moves with the binder ring until the additional draw depth required to form the deep drawn part is essentially equal to the draw depth of a shallow drawn part. A process for producing multiple unattached sheet metal parts in a single action draw press is also disclosed wherein a first sheet metal part has a draw depth $D_1$ and a second sheet metal part has a draw depth $D_2$.

19 Claims, 3 Drawing Sheets

DRAW PRESS WITH A FIXED DRAW PUNCH AND A FLOATING DRAW PUNCH

BACKGROUND OF THE INVENTION

1. Field of the Invention

A machine and process for simultaneously manufacturing a plurality of unattached parts having different draw depths in a single-action draw press.

2. Background Art

Draw presses are used to draw sheet metal blanks into three-dimensional shapes. Single-action draw presses generally include a draw die that is normally connected to the ram of the press and a binder ring and punch that are fixed to the bed of the press. A single-action draw press is operated by engaging the binder ring on the bed with the draw die that is moved reciprocally relative to the binder ring when the draw press is operated. A punch is normally fixed to the bed. The draw die engages the binder ring and moves the binder ring against the resistance of a press cushion toward the bed of the press. The binder ring is connected to the press cushion that is located below the bed of the press by press cushion pins that extend through holes in the bed. The punch is fixed to the bed of the press and draws the sheet metal blank into a desired shape.

In an effort to improve productivity and increase asset utilization, it has been proposed to manufacture two or more parts simultaneously in the same single-action draw press. This approach may be feasible for manufacturing mirror image parts having the same draw depth. However, it has not been possible to form multiple parts simultaneously if the draw depth of the first part substantially exceeds the draw depth of the second part to be formed at the same time. Forming parts on the same press that have different draw depths would require resolution of complicated draw punch and binder relationship issues during the binder set phase of the single-action draw press operation. Generally, parts of substantially different draw depths must be formed separately.

There is a need for a single-action draw die that can form multiple parts of substantially different draw depths in a single drawing operation. The binder ring must effectively register with the ram of the single-action draw press to control the blank during the forming operation. The present invention is also directed to solving other needs and problems as summarized below.

SUMMARY OF THE INVENTION

According to one aspect of the present invention, a machine is disclosed for producing a deep drawn part and a shallow drawn part from separate sheet metal blanks in a single-action draw press. The machine comprises first and second draw dies that are secured to a ram of the draw press. Each of the draw dies have different draw depths. A first draw punch is secured to a bed of the draw press. A second draw punch is supported on press cushion pins that engage a press cushion that is disposed below the bed. The first draw punch engages one of the blanks and draws the blank to an extent corresponding to the draw depth of the first draw die. A floating draw punch draws the second blank when the floating draw punch bottoms out on the bed. When the floating draw punch bottoms out on the bed, the first draw die has allegedly partially formed the first blank. First and second binder rings are supported on pins that extend through the bed of the draw press to the press cushion. Each of the binder rings is disposed around one of the first and second draw punches. The second draw punch is movable relative to the first draw punch and to the bed of the draw press until the second draw punch bottoms out on the bed.

According to other aspects of the invention as they relate to the machine of the present invention, the first draw punch may comprise a deep draw punch with the shallow draw punch being of lesser depth than the deep draw punch. The first and second draw punches further comprise a fixed draw punch and a floating draw punch, respectively. The fixed draw punch is fixedly secured to the bed of the press while the binder ring moves relative to the fixed punch after engagement by the first draw die. The floating draw punch and the second binder ring are both initially supported on press cushion pins that are, in turn, supported by the press cushion. The second draw die moves the floating draw punch and the second binder ring until the additional draw depth required to form a deep drawn part is essentially equal to the draw depth of the shallow draw punch. The floating draw punch bottoms out on the bed of the press and the ram continues to drive the binder rings downwardly to finish forming the deep drawn part and form the shallow drawn part. The binder rings are engaged by the draw dies that move the binder rings downwardly against the pressure of the press cushion. The two blanks are supported by the draw punches and the binder rings after the blanks are loaded into the draw press.

According to another aspect of the present invention, a process for producing multiple unattached sheet metal parts in a single-action draw press is disclosed. The single-action draw press has a single ram that reciprocates relative to the press bed. A press cushion is disposed below the bed and is supported by hydraulic or pneumatic pressure. A first sheet metal part has a draw depth $D_1$ and a second sheet metal part has a draw depth $D_2$ wherein $D_1$ is greater than $D_2$. The process comprises the steps of loading a first blank and a second blank into the draw press with the first and second blanks each being disposed on top of a binder ring and above one of the draw punches. The draw punch supporting the first blank is a fixed draw punch that is fixedly secured to a bed of the draw press. The draw punch supporting the second blank is a floating draw punch that is secured within a lower die shoe and is supported on press cushion pins that are supported on the press cushion for movement relative to the bed of the draw press. The ram supporting the draw dies for each of the first and second parts is lowered to engage the first and second blanks clamping the blanks to the binder rings. The first blank is partially drawn over the fixed draw punch as the binders and the floating draw punch move downwardly against the pressure of the press cushion. The floating draw punch bottoms out on the bed of the draw press to begin drawing the second part. The first part and second part are then drawn simultaneously until both parts are fully drawn. The draw dies, binders, and floating draw punch are then returned to the loading position and the first and second parts are unloaded from the draw press.

According to other aspects of the invention as they relate to the process, the first draw die may be used for forming a deep drawn part with the second draw die being used for forming a shallow drawn part. The floating draw punch moves with the binder ring until the added draw depth required to form a deep drawn part is essentially equal to the draw depth of a shallow drawn part. The floating punch bottoms out on the bed of the press and the ram continues forming the deep drawn part and the shallow drawn part. The binder rings are engaged by the draw dies that are moved by the ram to force the binder rings against the pressure applied by the press cushion. The draw punches and the binder rings support the two blanks when the blanks are loaded into the draw press.

According to another aspect of the present invention, a method of manufacturing a deep drawn sheet metal part and a shallow drawn sheet metal part that are formed at the same time in a draw press. The draw press is provided with at least two draw dies that are attached to a ram of the press. The draw press is provided with a fixed draw punch that is fixedly attached to the bed of the draw press. The floating draw punch is initially supported on pins that are supported for movement on the press cushion. The draw press is provided with at least two binder rings that are supported on pins that are movable relative to the bed of the draw press. Each binder ring is disposed around one of the draw punches. The method comprises the steps of loading first and second blanks into the draw press with the blanks being disposed on top of the binder rings and above the draw punches. The draw dies are lowered to engage both blanks and clamp the blanks to both of the binder rings. The deep drawn part is partially drawn over the fixed draw punch as the draw die and the binder of the deep drawn part move downwardly. The binder of the floating draw punch and the floating draw punch of the shallow drawn part shift downwardly against the force of the press cushion during the step of partially drawing the deep drawn part. The floating draw punch bottoms out on the bed of the press at which point the deep drawn part continues to be drawn and the shallow drawn part begins to be drawn. The draw dies, binders, and floating draw punch are then returned to the loading position and the parts are unloaded from the draw press.

According to other aspects of the method of manufacturing, the two draw dies may further comprise a deep draw die and a shallow draw die. The two punches further comprise a fixed punch and a floating punch. The floating punch moves with the binder ring until the added draw depth required to form a deep drawn part is essentially equal to the draw depth of the shallow drawn part. The floating punch bottoms out on the bed of the press and the ram continues forming the deep drawn part and the shallow drawn part. The binder rings are each engaged by one of the draw dies that move the binder rings downwardly. The punches and binder rings support the two blanks after the blanks are loaded into the draw press.

These and other aspects of the present invention will be better understood in view of the attached drawings and the following detailed description of the illustrated embodiments of the invention.

DETAILED DESCRIPTION OF THE PREFERRED EMBODIMENT(S)

Figure 1:
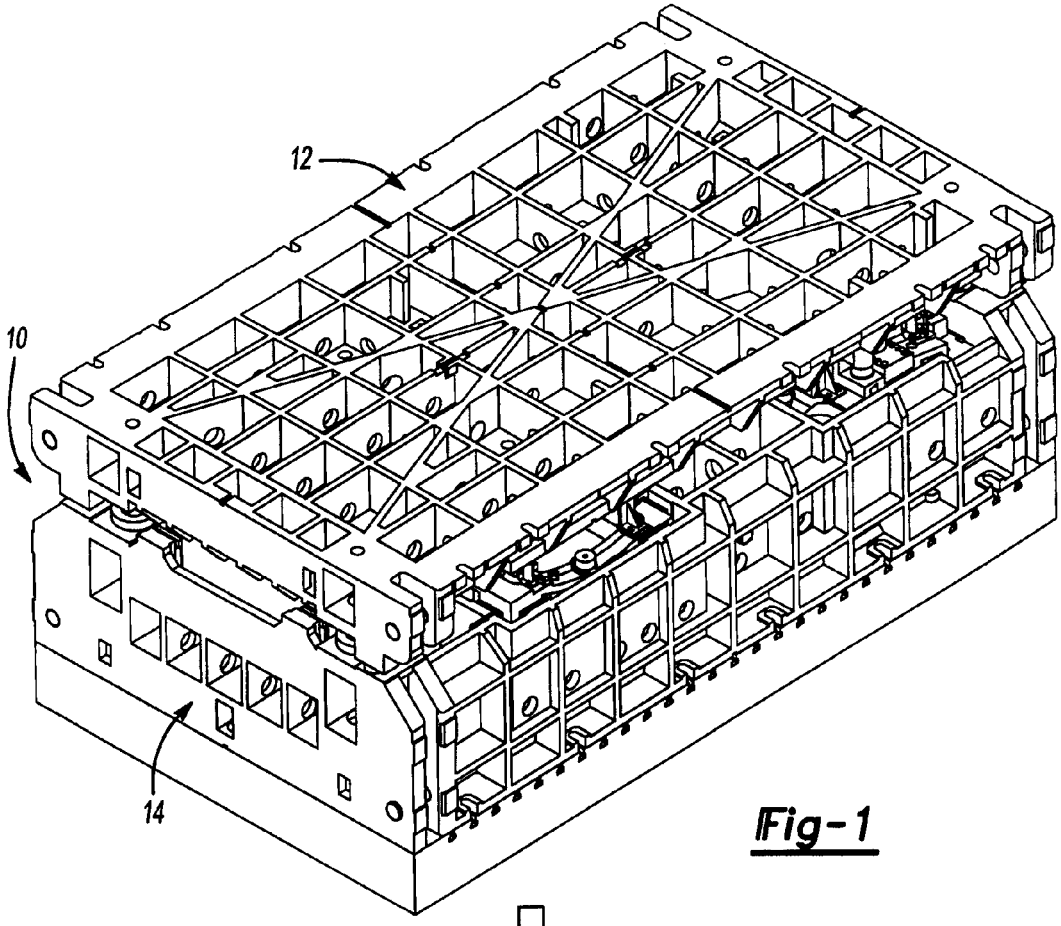
FIG. 1 is a perspective view of a die set for a single-action draw press that has two stations for forming two different parts in the same draw operation.

Referring to FIG. 1, a die set 10 is shown in its closed position with the upper die shoe 12 in engagement with the lower die shoe 14.

Figure 2:
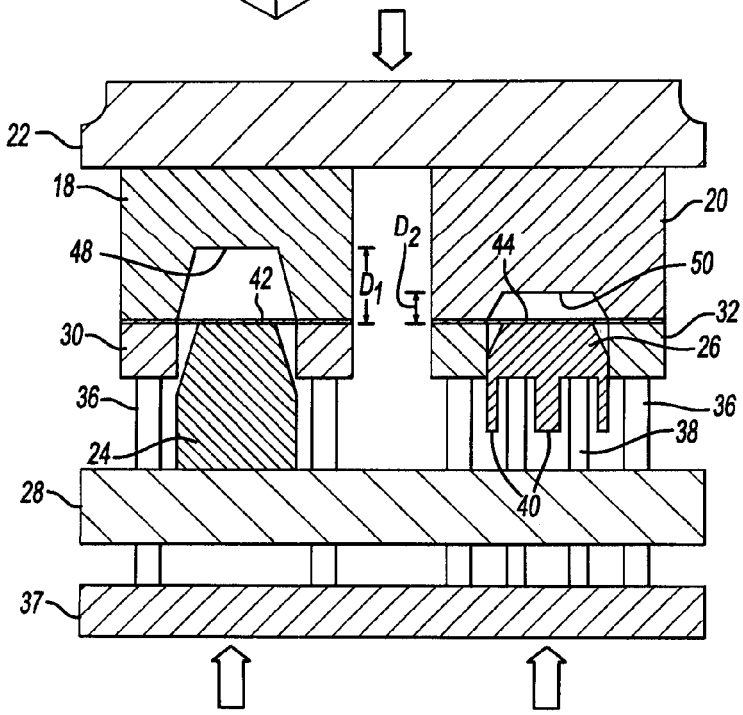
FIG. 2 is a diagrammatic cross-sectional view showing a portion of a single-action draw press for forming a deep drawn part and a shallow drawn part wherein the deep drawn part has a fixed punch, while the shallow drawn part has a floating punch, wherein the apparatus is shown with the draw dies engaging blanks that are supported by the binder ring and punches.

Referring to FIG. 2, a first draw die 18 and a second draw die 20 are connected to the ram 22 of a single action draw press. A first draw punch 24 and a second draw punch 26 are shown in conjunction with the bed 28 of the single action draw press. The first draw punch 24 is fixedly secured to the bed 28. The second draw punch 26 is initially movable relative to the bed 28. A first binder ring 30 and a second binder ring 32 are moveably connected to the bed 28 by press cushion pins 36. The press cushion pins 36 may be cylindrical bars that are supported on the press cushion 37 that guide the upward and downward movement of the first and second binder rings 30 and 32 relative to the bed 28 of the press. Floating draw punch press cushion pins 38 moveably support the second draw punch 26 on the press cushion for movement relative to the bed 28 of the press. A bottoming surface 40 is provided on the second draw punch 26 that engages the bed 28 of the press when the forming operation of the second draw punch 26 commences, as will be described more fully below.

A first blank 42 is loaded between the first draw die 18 and the first draw punch 24 that is encompassed by the first binder ring 30. A second blank 44 is loaded between the second draw die 20 and second draw punch 26 that is encompassed by the second binder ring 32. When the first blank 42 is loaded into the die set 10, it is supported on the first draw punch 24 and the first binder ring 30 so that it does not sag prior to the forming operation. Likewise, the second blank 44 is supported by the second draw punch 26 and second binder ring 32. The second draw punch 26 may also be referred to as a floating draw punch.

In the position shown in FIG. 2, the first and second draw dies 18 and 20 are shown engaging in the first and second blanks 42 and 44 to hold them against the first and second binder rings 30 and 32. The central portion of the first and second blanks 42 and 44 are supported by the first draw punch 24 and the second draw punch 26, respectively. As shown in FIG. 2, the bottoming surface 40 of the second draw punch is spaced from the bed 28. Draw depth $D_1$ for the first draw die 18 and draw depth $D_2$ of the second draw die 20 are also indicated in FIG. 2.

Figure 3:
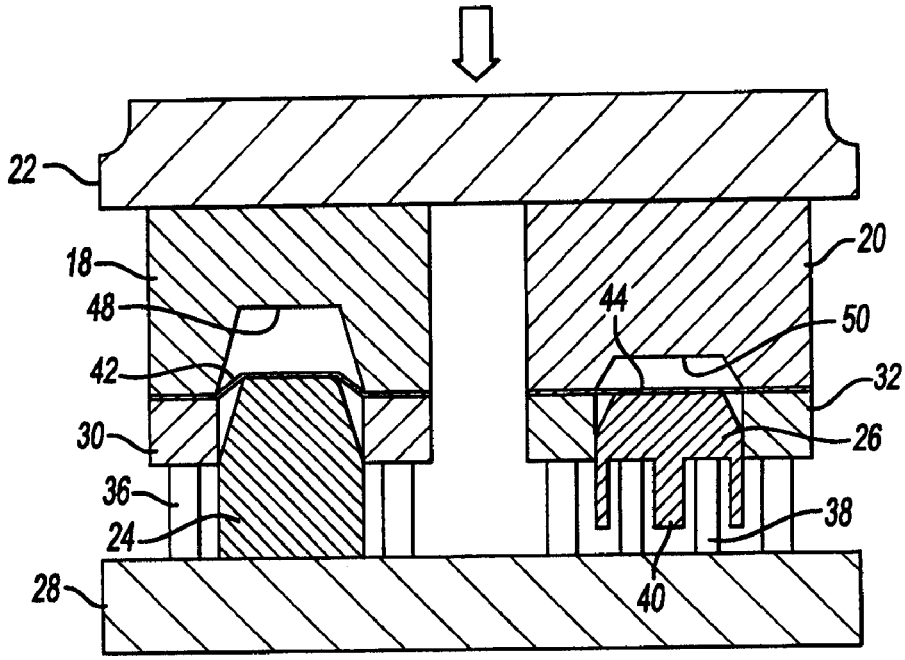
FIG. 3 is a view similar to FIG. 2, but showing the deep drawn part being formed by the fixed punch while the floating punch used to form the shallow drawn part is shifted toward the press bed.

Referring to FIG. 3, the first draw die 18 is shown as it begins to form the blank 42 over the first draw punch 24. The periphery of the blank 42 is clamped between the first draw die 18 and the first binder ring 30 as the central portion of the blank 42 is drawn over the first draw punch 24. At the same time, the second draw die 20 is shown in engagement with the second binder ring 32. The second binder ring 32 and the second draw punch 26 are supported on press cushion pins and the press cushion and are shifted downwardly towards the bed 28 of the press. No substantial forming of the second blank 44 occurs during this phase of the production cycle because the second draw punch 26 moves downwardly with the second binder ring 32 on the press cushion pins 38 and 36, respectively.

Figure 4:
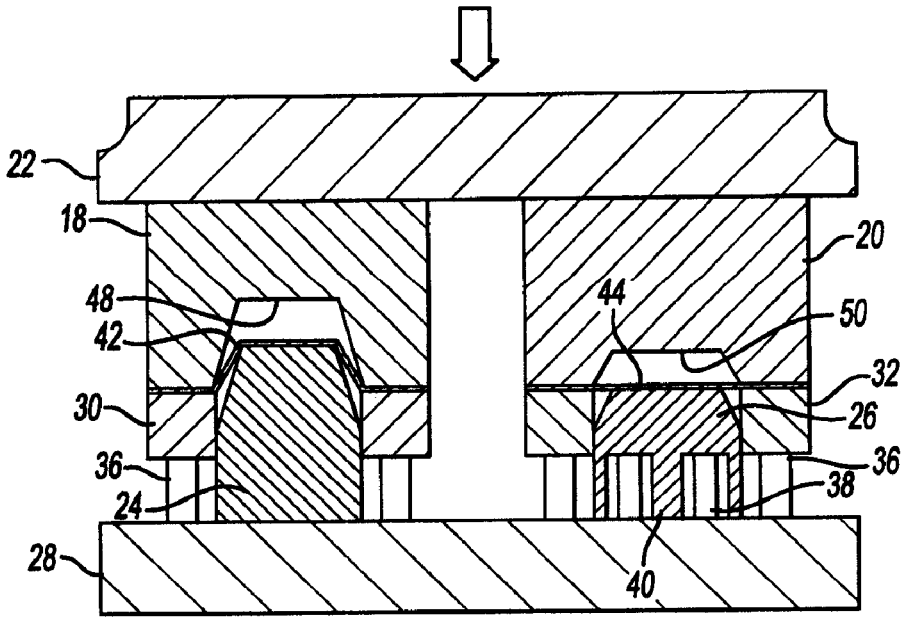
FIG. 4 is a view similar to FIGS. 2 and 3, but showing the deep drawn part being more fully formed and the floating punch bottomed on the bed of the press.

Referring to FIG. 4, the process is shown at the point at which the first draw die 18 has traveled a distance corresponding to the difference between draw depth $D_1$ and draw depth $D_2$. At this point, the bottoming surface 40 initially engages the bed 28 of the press. The floating draw punch 26 stops moving while the second binder ring 32 remains free to continue moving downwardly with the second draw die 20 relative to the second, or floating, draw punch 26.

Figure 5:
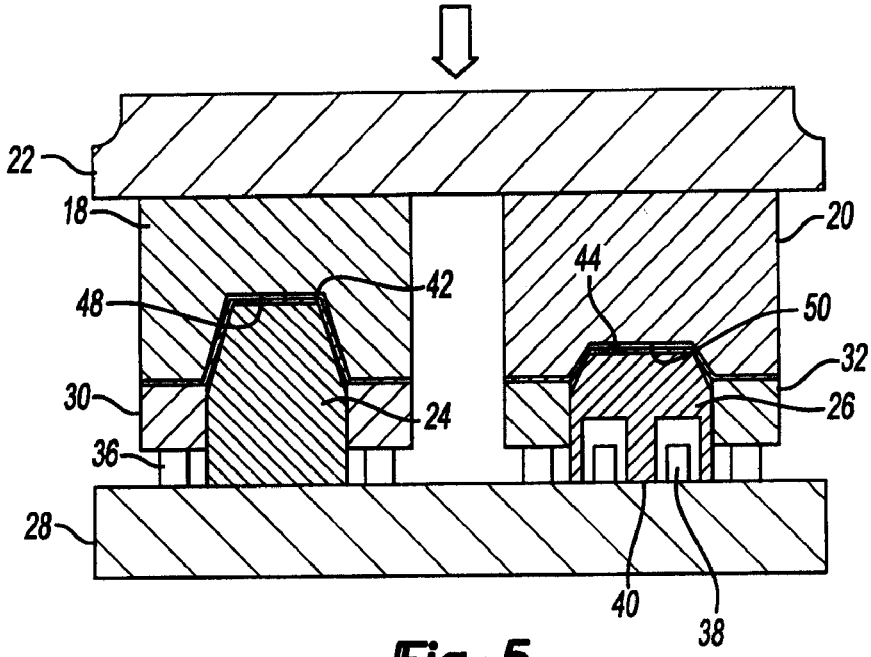
FIG. 5 is a view similar to FIGS. 2-4 showing the deep drawn part and the shallow drawn part being nearly completely formed with the punch for the shallow drawn part drawing one of the blanks to a lesser extent than the fixed punch of the deep drawn part.

Referring to FIG. 5, the first and second draw dies 18 and 20 are shown having been moved to a point that is near the bottom of the press cycle. Both of the blanks 42 and 44 have been substantially formed with a small degree of formation still remaining. The first and second draw dies 18 and 20 and the first and second binder rings 30 and 32 are shifted downwardly relative to the first and second draw punches 24 and 26 resulting in the simultaneous drawing of the two parts.

Figure 6:
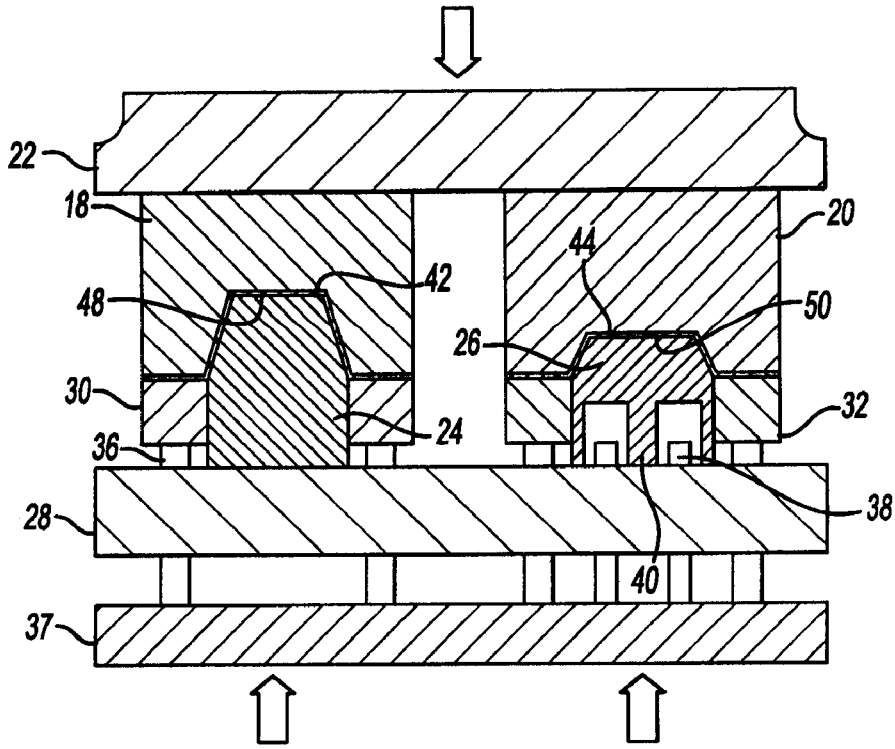
FIG. 6 is a view similar to FIGS. 2-5 showing the deep drawn part and shallow drawn part completely formed in the die cavity.

Referring to FIG. 6, the process is shown at the point at which the first draw die 18 and the second draw die 20 have traveled a distance corresponding to drawn depth $D_1$. The first and second blanks 42 and 44 are shown fully formed with the first blank being formed in a deep draw cavity 48 defined by the first draw die 18. The second blank 44 is shown fully formed in the shallow draw cavity 50 of the second draw die 20. The binder rings 30 and 32 and floating draw punch 26 are shown in their fully closed position with the parts having been formed from the first and second blanks 42 and 44. The press begins to open and return to its initial position with the first and second draw dies 18 and 20 being spaced from the first and second binder rings 30 and 32 and the draw punches 24 and 26 to permit unloading the formed parts and loading of a new set of blanks. The cycle is then repeated to form additional parts.

While the best mode for carrying out the invention has been described in detail, those familiar with the art to which this invention relates will recognize various alternative designs and embodiments for practicing the invention as defined by the following claims.

What is claimed is:

1. A machine for producing a deep drawn part and a shallow drawn part from first and second sheet metal blanks in a single action draw press, comprising:

first and second draw dies secured to a ram of the draw press, wherein each of the draw dies have different draw depths;

a first draw punch is secured to a bed of the draw press, a second draw punch is movably supported on a first set of press cushion pins, wherein the first and second draw punches each engage one of the blanks and draw one of the blanks to the draw depth of one of the draw dies;

first and second binder rings are movably supported on a second set of press cushion pins, wherein each of the binder rings is disposed around one of the first and second draw punches; and wherein the second draw punch is moveable relative to the first draw punch and to the bed of the draw press until the second draw punch bottoms out on the bed.

2. The machine of claim 1 wherein the first draw punch further comprises a deep draw punch and the second draw punch comprises a shallow draw punch, wherein the shallow draw punch is not as deep as the deep drawn punch.

3. The machine of claim 1 wherein the first draw punch further comprises a fixed draw punch and the second draw punch comprises a floating draw punch.

4. The machine of claim 3 wherein the fixed draw punch is fixedly connected to the bed of the press while the first binder ring moves relative to the fixed draw punch, and wherein the floating draw punch and the second binder ring move until an additional draw depth required to form a deep drawn part is essentially equal to a draw depth of the floating draw punch, whereupon the floating draw punch bottoms out and the ram continues forming the deep drawn part and begins forming the shallow drawn part.

5. The machine of claim 4 wherein the fixed punch is fixedly attached to the bed of the draw press.

6. The machine of claim 1 wherein the first and second binder rings are engaged by the draw dies that move the binder rings downwardly on the second set of press cushion pins.

7. The machine of claim 1 wherein the draw punches and the two binder rings support the two blanks after the blanks are loaded into the draw press.

8. A process for producing multiple unattached sheet metal parts in a single action draw press having single ram that reciprocates relative to a press bed, wherein a first sheet metal part has a draw depth $D_1$ and a second sheet metal part has a draw depth $D_2$, wherein $D_1$ is greater than $D_2$, the process comprising the steps of:

loading a first blank and a second blank into the draw press with the first and second blanks each being disposed on top of a binder ring and above a draw punch, wherein the draw punch supporting the first blank is a fixed draw punch that is secured to a bed of the draw press and the draw punch supporting the second blank is a floating draw punch that is secured within a lower die shoe and is supported by a plurality of press cushion pins for movement relative to the bed of the draw press;

lowering the ram that supports a draw die for each of the first part and second part that each engage one of the first and second blanks and clamp the blanks to one of the binder rings;

partially drawing the first blank over the fixed draw punch and moving the binder supporting the first blank downwardly;

shifting the binder and the floating draw punch supporting the second blank downwardly during the step of partially drawing the first part;

bottoming the floating draw punch on the bed of the draw press;

drawing the first part and the second part until both parts are fully drawn;

returning the draw dies, the binders and the floating draw punch to the loading position; and unloading the first and second parts from the draw press.

9. The process of claim 8 wherein one of the draw dies forms a deep drawn part and the other draw die forms a shallow drawn part, wherein the shallow drawn part is not as deep as the deep drawn part.

10. The process of claim 8 wherein the floating draw punch moves with the binder ring until the added draw depth required to form a deep drawn part is essentially equal to the draw depth of a shallow drawn part, wherein the floating punch bottoms out on the bed of the press and the ram continues forming the deep drawn part and the shallow drawn part.

11. The process of claim 10 wherein the fixed punch is fixedly attached to the bed of the draw press.

12. The process of claim 8 wherein the two binder rings are engaged by the draw dies that move the binder rings downwardly.

13. The process of claim 8 wherein the draw punches and the binder rings support the two blanks as the blanks are loaded into the draw press.

14. A method of manufacturing a deep drawn sheet metal part and a shallow drawn sheet metal part that is not as deep as the deep drawn part at the same time in a draw press, the draw press being provided with at least two draw dies that are attached to a ram, the draw press being provided with a fixed draw punch that is fixedly attached to the bed of the draw press, and a floating draw punch that is initially supported on a first set of movable pins that are supported by a press cushion, and the draw press being provided with at least two binder rings that are attached to a second set of pins that are movable relative to the bed of the draw press, the method comprising:

loading first and second blanks into the draw press with the blanks being disposed on top of the binder rings and above the draw punches;

lowering the draw dies to engage both of the blanks and clamp the blanks to both of the binder rings;

partially drawing the deep drawn part over the fixed draw punch and moving the draw die and the binder of the deep drawn part downwardly;

shifting the binder of the floating draw punch and floating draw punch of the shallow drawn part downwardly during the step of partially drawing the deep drawn part;

bottoming the floating draw punch on the bed of the draw press;

drawing the deep drawn part and the shallow drawn part after the floating draw punch is bottomed on the die bed until both parts are fully drawn;

returning the draw dies, the binders, and floating draw punch to the loading position; and unloading the parts from the draw press.

15. The method of manufacturing of claim 14 wherein the at least two draw dies further comprise a draw die for a deep drawn part and a draw die for a shallow drawn part.

16. The method of manufacturing of claim 14 wherein the floating draw punch initially moves relative to the bed of the draw press with the binder of the floating punch before bottoming on the bed of the draw press.

17. The method of manufacturing of claim 14 wherein the floating draw punch moves with the binder ring until a draw depth required to finish forming the deep drawn part is essentially equal to a draw depth of the shallow drawn part, wherein the floating punch bottoms out and the ram continues forming the deep drawn part and the shallow drawn part.

18. The method of manufacturing of claim 14 wherein the binder rings are engaged by one of the draw dies that move the binder rings downwardly.

19. The method of manufacturing of claim 14 wherein the draw punches and the two binder rings support two blanks after the blanks are loaded into the draw press.

* * * * *